US011480922B2

(12) United States Patent
Mukaiyama

(10) Patent No.: US 11,480,922 B2
(45) Date of Patent: Oct. 25, 2022

(54) TIMEPIECE

(71) Applicant: Seiko Epson Corporation, Tokyo (JP)

(72) Inventor: Keiichi Mukaiyama, Matsumoto (JP)

(73) Assignee: SEIKO EPSON CORPORATION

( * ) Notice: Subject to any disclaimer, the term of this patent is extended or adjusted under 35 U.S.C. 154(b) by 359 days.

(21) Appl. No.: 16/801,365

(22) Filed: Feb. 26, 2020

(65) Prior Publication Data

US 2020/0272103 A1 Aug. 27, 2020

(30) Foreign Application Priority Data

Feb. 27, 2019 (JP) ..... JP2019-033602

(51) Int. Cl.
*G04B 1/16* (2006.01)
*G04B 11/04* (2006.01)

(52) U.S. Cl.
CPC ..... *G04B 1/16* (2013.01); *G04B 11/04* (2013.01)

(58) Field of Classification Search
CPC ..... G04B 11/04; G04B 35/00; G04B 11/006; G04B 5/14; G04B 1/16; G04C 3/06
See application file for complete search history.

(56) References Cited

U.S. PATENT DOCUMENTS 3,628,325 A * 12/1971 Morita ..... G04B 5/14 968/50
3,901,021 A * 8/1975 Tutiya ..... G04B 11/006 968/83
4,174,607 A * 11/1979 Wuthrich ..... G04B 5/14 968/50
6,422,348 B1 * 7/2002 Jujo ..... G04B 5/14 74/432
6,485,172 B1 11/2002 Takahashi et al.
6,814,483 B2 * 11/2004 Watanabe ..... G04B 5/14 368/207
10,890,877 B2 * 1/2021 Guffond ..... G04B 11/04
2018/0164744 A1 6/2018 Hiraya

FOREIGN PATENT DOCUMENTS

JP H11-183645 A 7/1999
JP H11-194173 A 7/1999
JP 2003-222682 A 8/2003
JP 2018-096813 A 6/2018

* cited by examiner

*Primary Examiner* — Edwin A. Leon
(74) *Attorney, Agent, or Firm* — Harness, Dickey & Pierce, P.L.C.

(57) ABSTRACT

Provided is a timepiece that improves the ease of unwinding a spring. The timepiece has a bridge disposed between the rotor and the main plate when seen in a side view; a pawl lever that is disposed between the rotor and bridge in side view, moves bidirectionally in a direction toward and a direction away from the transmission wheel in conjunction with the rotor, and causes the transmission wheel to turn in one direction; a release mechanism that is disposed to the bridge, and can change between an engaged state in which the pawl lever and the transmission wheel are engaged, and a released state in which the pawl lever and the transmission wheel are not engaged; and a train bridge disposed in side view between the pawl lever and the rotor, and having a first hole disposed to a position superimposed with the release mechanism when seen in a plan view.

6 Claims, 12 Drawing Sheets

TIMEPIECE

BACKGROUND

1. Technical Field

The present invention relates to a timepiece.

The present application claims priority based on and incorporates by reference the entire contents of Japan Patent Application No. 2019-033602 filed in Japan on Feb. 27, 2019.

2. Related Art

JP-A-2018-96813 discloses a mechanical timepiece having an automatic spring winding mechanism, and two through-holes in a wheel train bridge as a release mechanism for disengaging the pawl lever and a transmission wheel. Because engagement of the pawl lever and transmission wheel can be disengaged by insertion of pins or other members in the through-holes, the mechanical timepiece described in JP-A-2018-96813 enables unwinding the spring without removing the wheel train bridge.

However, with the mechanical timepiece described in JP-A-2018-96813 the operation of unwinding the spring must be executed while the pins or other members are inserted to the two through-holes to release engagement of the pawl lever and transmission wheel. More specifically, because three operations, that is, the operation of inserting a pin or other member to one through-hole and releasing engagement of the pawl lever on one side, the operation of inserting a pin or other member to the other through-hole and releasing engagement of the pawl lever on the other side, and the operation of unwinding the spring, must be executed at the same time, the task of unwinding the spring is complicated.

SUMMARY

A timepiece according to an aspect of the present disclosure includes: a main plate; a barrel including a barrel arbor and a spring; a ratchet wheel configured to rotate in unison with the barrel arbor and wind the spring; a rotor that rotates centered on a pivot; a transmission wheel that causes the ratchet wheel to turn; a bridge disposed between the rotor and the main plate when seen in a side view from a direction perpendicular to the pivot; a pawl lever that is disposed in the side view between the rotor and bridge, moves bidirectionally in a direction toward and a direction away from the transmission wheel in conjunction with the rotor, and causes the transmission wheel to turn in one direction; a release mechanism that is disposed to the bridge, and can change between an engaged state in which the pawl lever and the transmission wheel are engaged, and a released state in which the pawl lever and the transmission wheel are not engaged; and a train bridge disposed in the side view between the pawl lever and the rotor, and having a first hole disposed to a position superimposed with the release mechanism when seen in a plan view from a direction parallel to the pivot.

In a timepiece according to another aspect of the present disclosure the pawl lever and the transmission wheel are axially supported by the main plate and the train bridge.

In a timepiece according to another aspect of the present disclosure the pawl lever includes two pawl lever parts disposed in plan view with the transmission wheel therebetween; the release mechanism is an eccentric pin disposed between one of the pawl lever parts and the transmission wheel, and is rotatable between an engaged position where the one pawl lever part and the transmission wheel change to the engaged state, and a release position where the one pawl lever part and the transmission wheel change to the released state; and the train bridge has a second hole disposed in plan view to a position where part of the second hole is superimposed with the other pawl lever part, and the remaining part of the hole is superimposed with a space between the other pawl lever part and the pawl lever.

In a timepiece according to another aspect of the present disclosure the pawl lever includes two pawl lever parts disposed in plan view with the transmission wheel therebetween; and the release mechanism is an eccentric pin disposed between one pawl lever part and the other pawl lever part, and is rotatable between an engaged position where the one pawl lever part and the other pawl lever part change to the engaged state engaging the transmission wheel, and a release position where the one pawl lever part and the other pawl lever part change to the released state not engaged with the transmission wheel.

In a timepiece according to another aspect of the present disclosure a position indicator that indicates the engaged state or the released state of the release mechanism is disposed to the train bridge.

A timepiece according to another aspect of the present disclosure includes a main plate; a barrel including a barrel arbor and a spring; a ratchet wheel configured to rotate in unison with the barrel arbor and wind the spring; a rotor that rotates centered on a pivot; a transmission wheel that causes the ratchet wheel to turn; a pawl lever that is disposed in a side view from a direction perpendicular to the pivot between the rotor and the main plate, moves bidirectionally in a direction toward and a direction away from the transmission wheel in conjunction with the rotor, and causes the transmission wheel to turn in one direction; a train bridge disposed in the side view between the pawl lever and the rotor; and a release mechanism that is disposed to the train bridge, and can change between an engaged state in which the pawl lever and the transmission wheel are engaged, and a released state in which the pawl lever and the transmission wheel are not engaged.

Other objects and attainments together with a fuller understanding of the invention will become apparent and appreciated by referring to the following description and claims taken in conjunction with the accompanying drawings.

DESCRIPTION OF EMBODIMENTS

Embodiment 1

A timepiece 1 according to the first embodiment of the present disclosure is described below with reference to FIG. 1 to FIG. 10.

Figure 1:
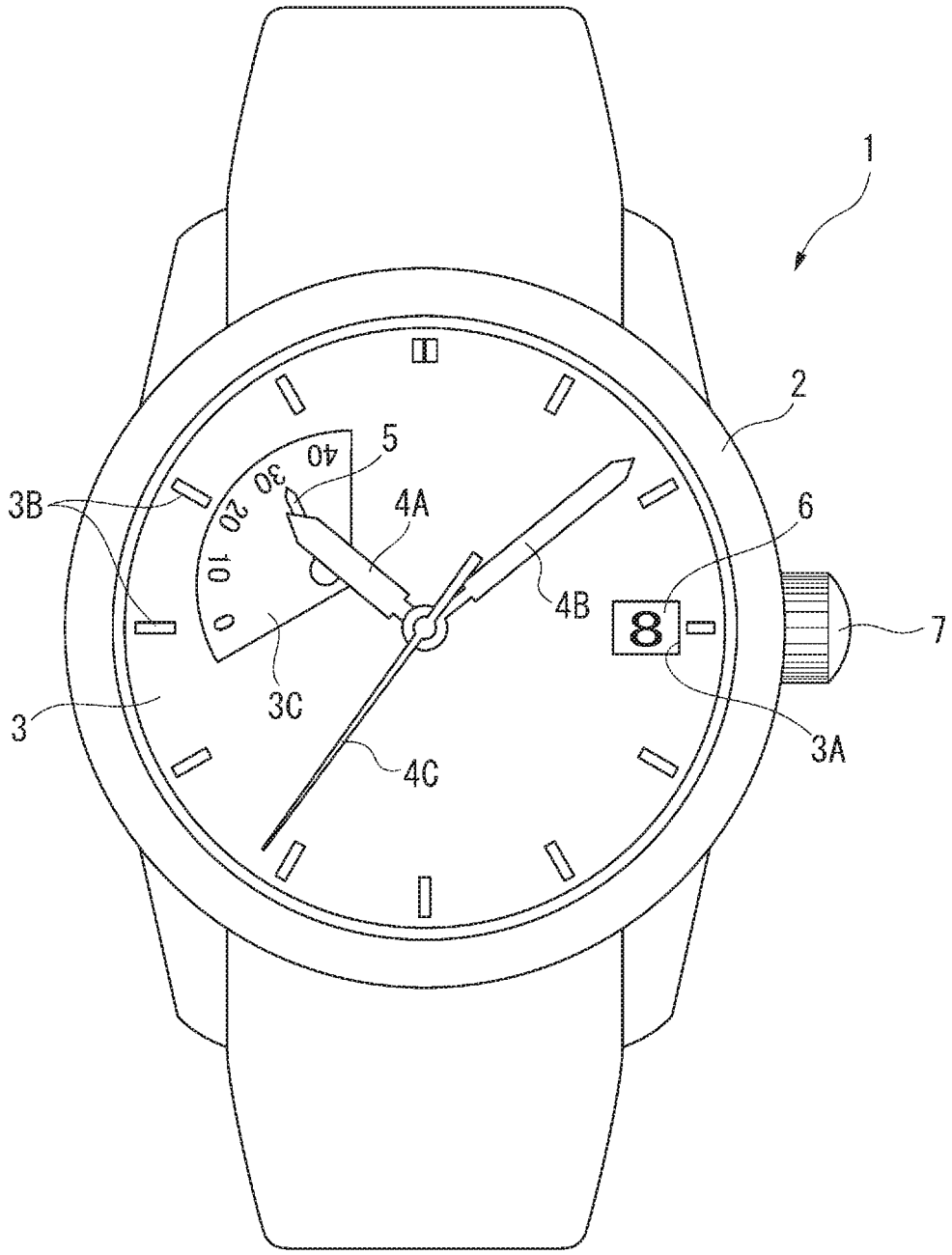
FIG. 1 is a front view of a timepiece according to the first embodiment.

FIG. 1 is a front view of a timepiece 1 according to the present disclosure. This timepiece 1 is a wristwatch typically worn on the wrist of the user, and has a cylindrical external case 2, and a dial 3 disposed on the inside circumference side of the external case 2.

Herein, the side of the timepiece 1 that contacts the wrist when the timepiece 1 is worn is referred to as the back cover side of the timepiece 1, and the opposite side as the back cover is referred to as the front or face side of the timepiece 1. Of the two major openings in the external case 2, the opening on the face side is covered by a crystal, and the opening the back side is covered by a back cover.

Figure 2:
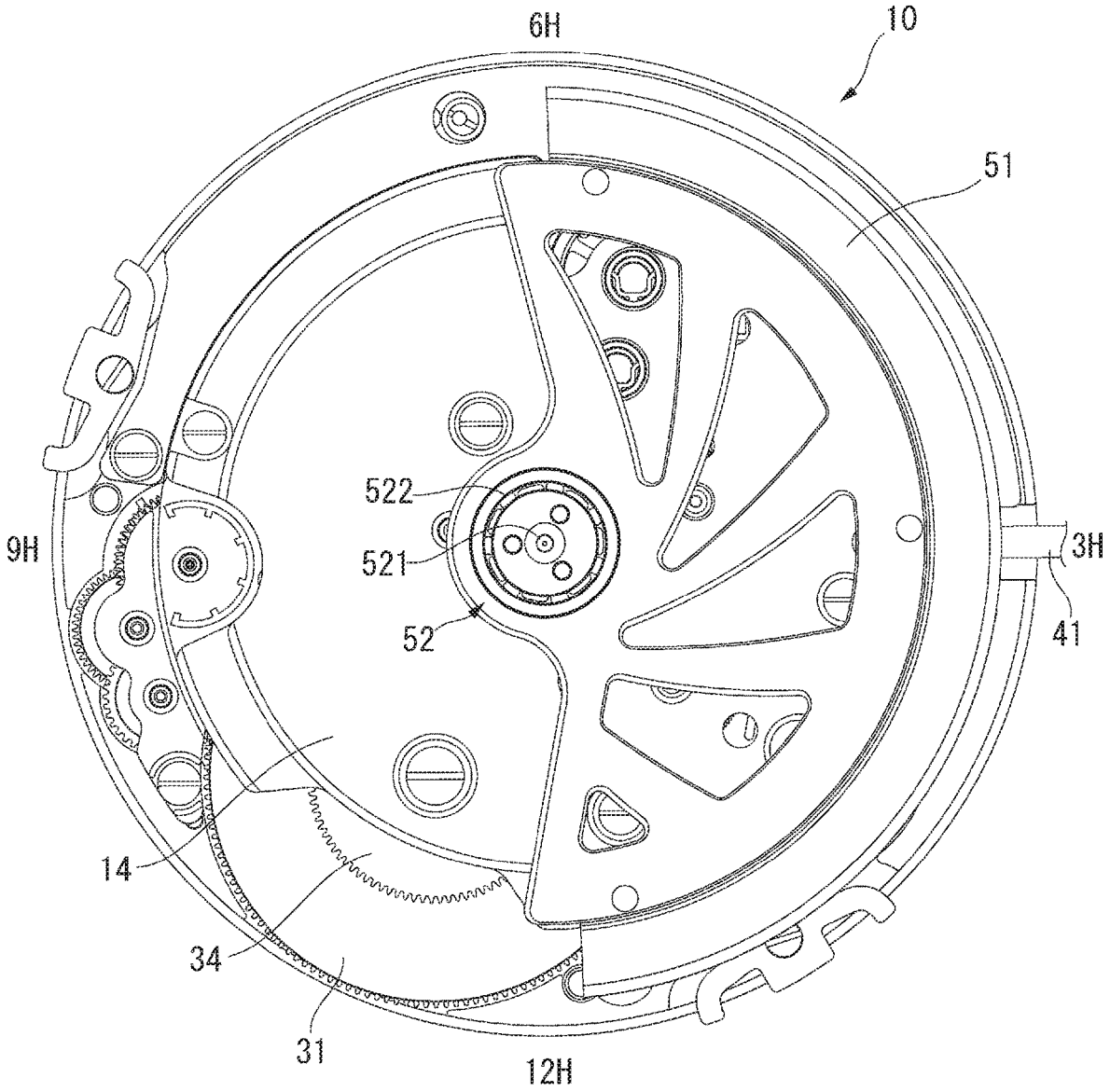
FIG. 2 is a plan view showing main parts of the movement in the first embodiment.
Figure 3:
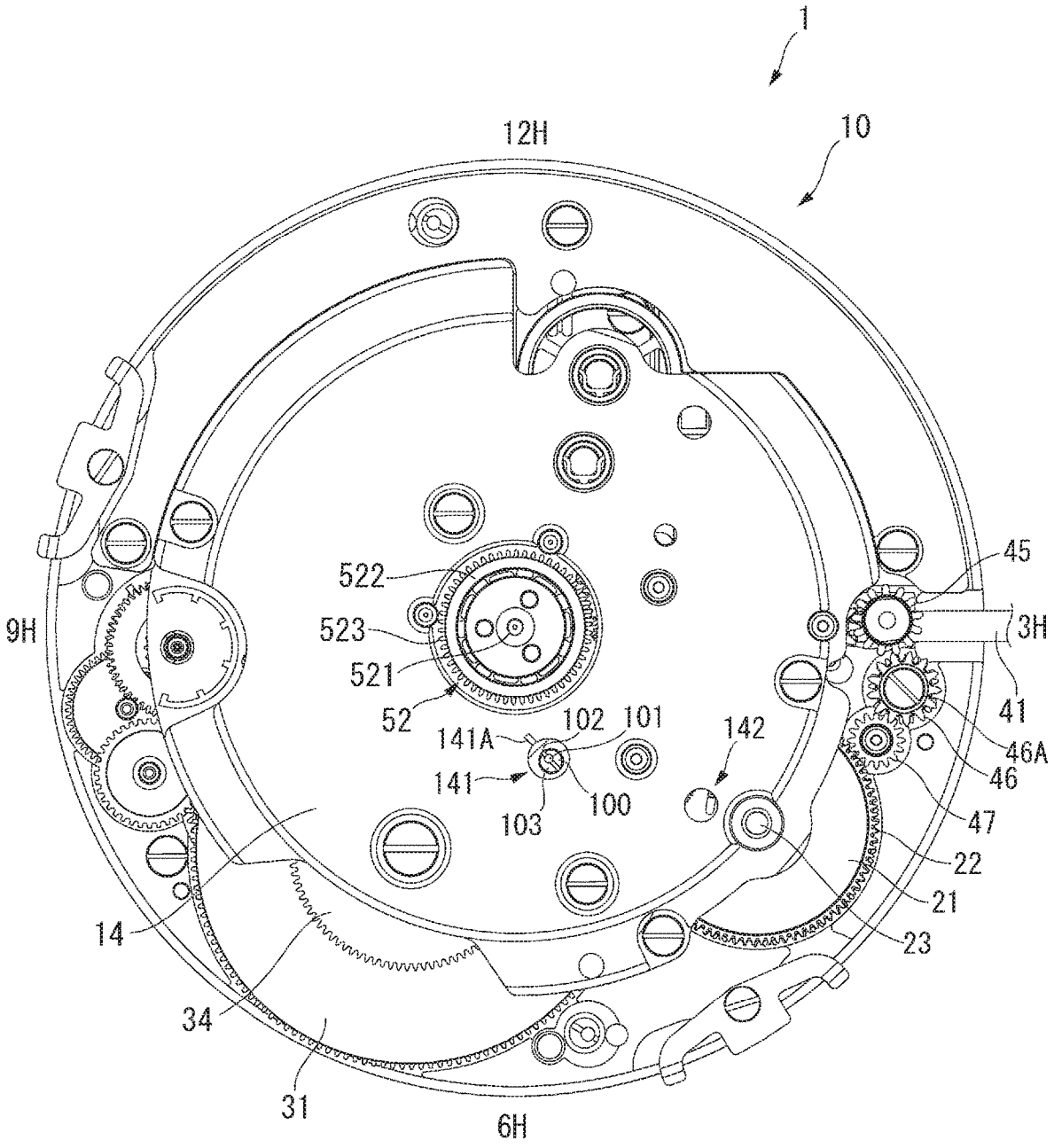
FIG. 3 is a plan view showing main parts of the movement in the first embodiment.
Figure 4:
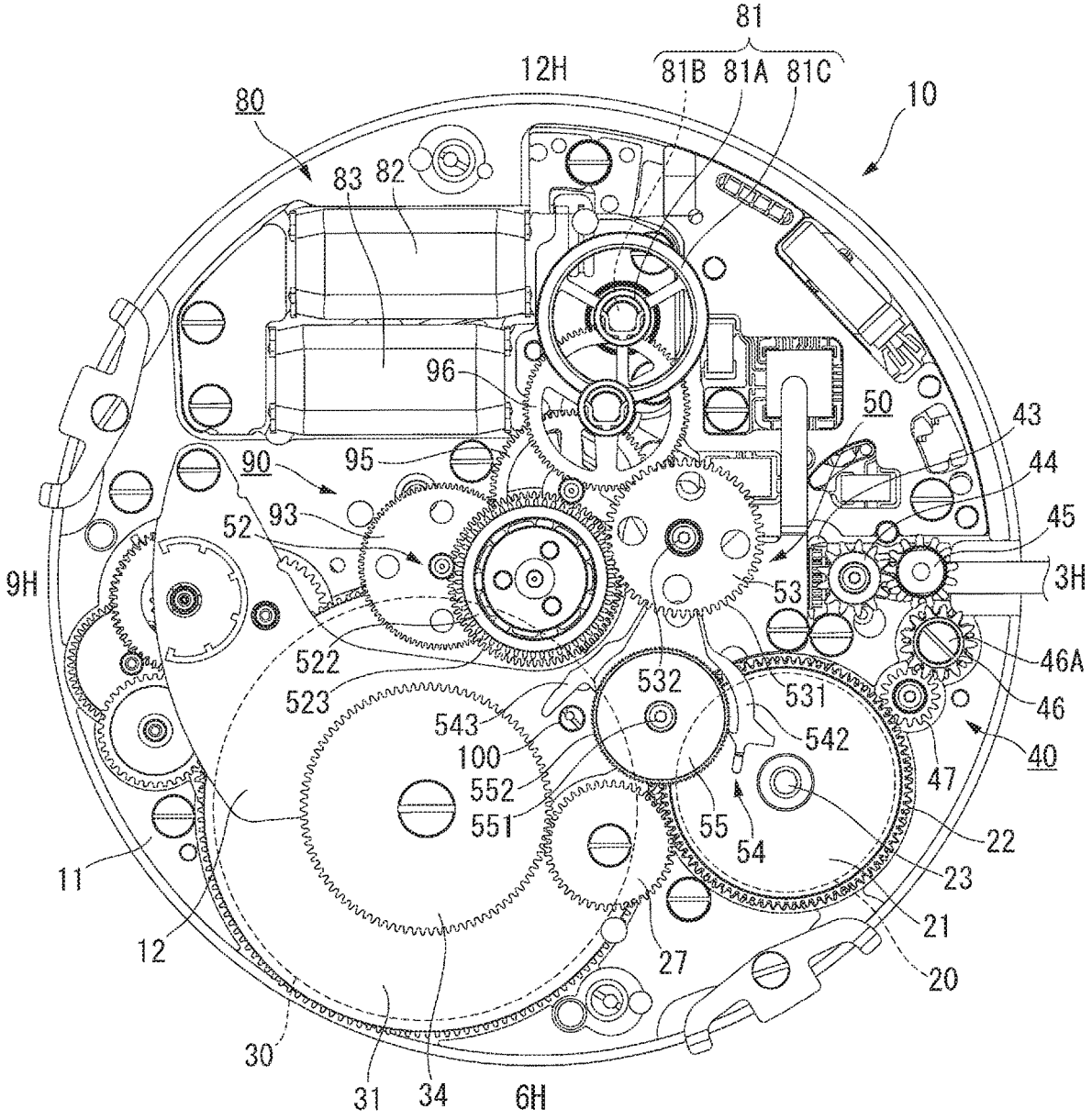
FIG. 4 is a plan view showing main parts of the movement in the first embodiment.

The timepiece 1 has a movement 10 as shown in FIG. 2 to FIG. 4 housed inside the external case 2, an hour hand 4A, minute hand 4B, and second hand 4C for indicating time information as shown in FIG. 1, and a power reserve indicator 5 for indicating the duration time. A calendar window 3A is also formed in the dial 3, and the date indicator 6 can be seen through the calendar window 3A. Hour markers 3B for indicating the time, and a fan-shaped subdial 3C for indicating the duration time by the power reserve indicator 5, are also disposed to the dial 3.

A crown 7 is disposed in the side of the external case 2. The crown 7 can move from a 0 stop position to which the crown 7 is pushed in toward the center of the timepiece 1, to a first stop position and a second stop position.

When the crown 7 is turned at the 0 stop position, a first spring 20 and a second spring 30 disposed in the movement 10 and described below can be wound. The power reserve indicator 5 moves in conjunction with winding the first spring 20 and a second spring 30. Because the timepiece 1 according to this embodiment has two springs, first spring 20 and second spring 30, the duration time is greater than in a timepiece having only one spring.

When the crown 7 is pulled out to the first stop position and wound, the date indicator 6 moves and the date can be adjusted. When the crown 7 is pulled to the second stop position, the second hand 4C stops, and when the crown 7 is then turned at the second stop, the hour hand 4A and minute hand 4B move and the time can be set. Adjusting the date indicator 6, hour hand 4A, and minute hand 4B by means of the crown 7 is the same as with a conventional mechanical timepiece, and further description thereof is omitted.

Movement

Figure 5:
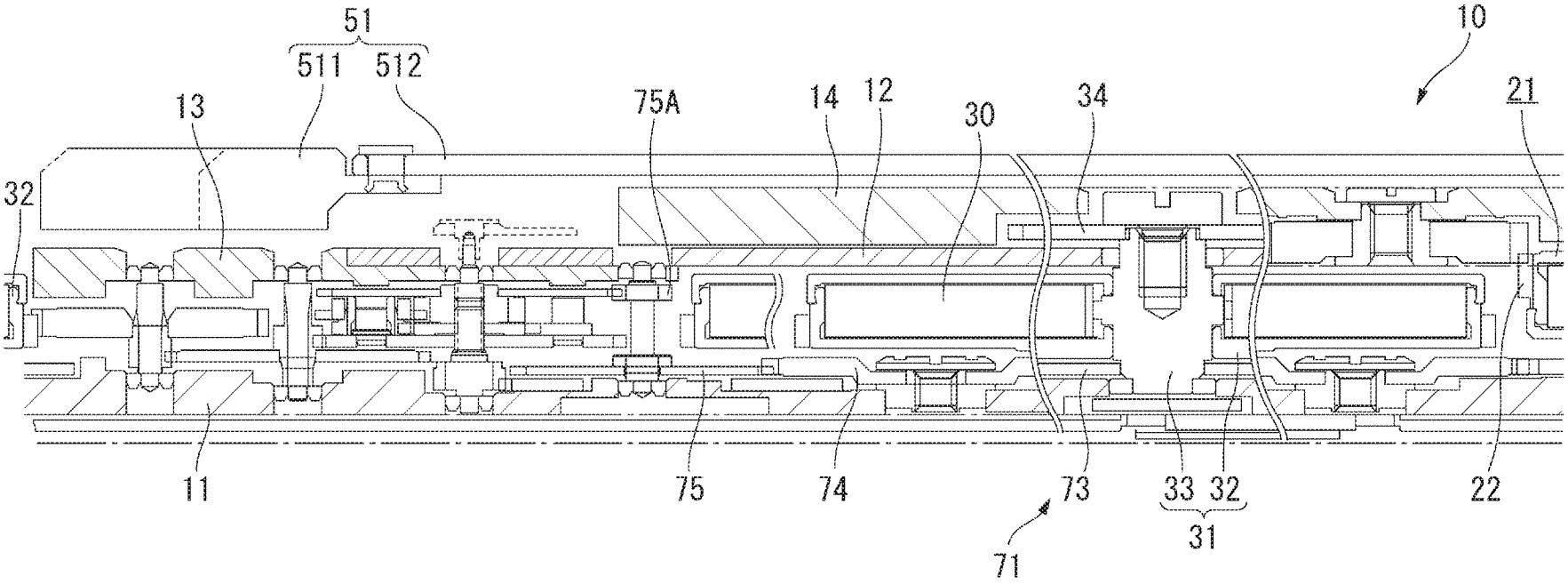
FIG. 5 is a plan view showing main parts of the movement in the first embodiment.
Figure 6:
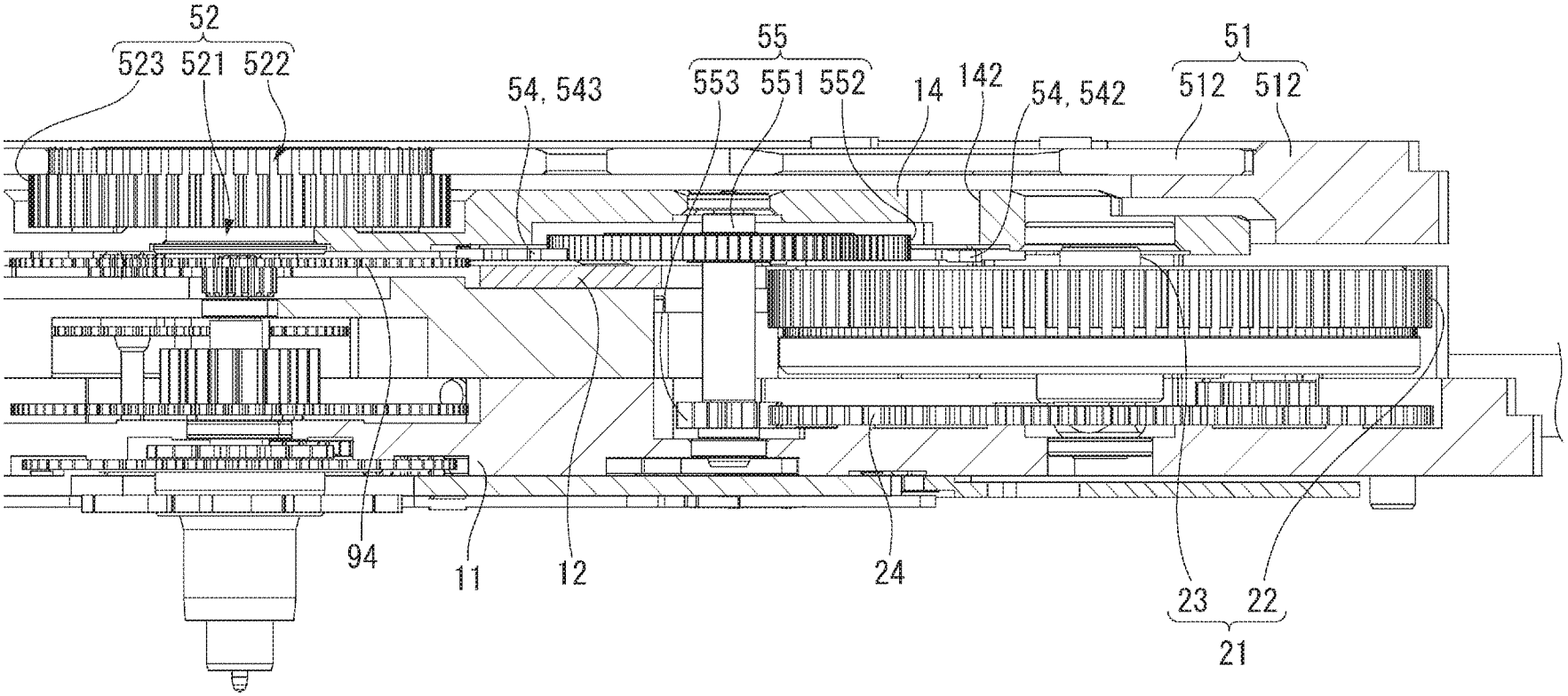
FIG. 6 is a plan view showing main parts of the movement in the first embodiment.
Figure 7:
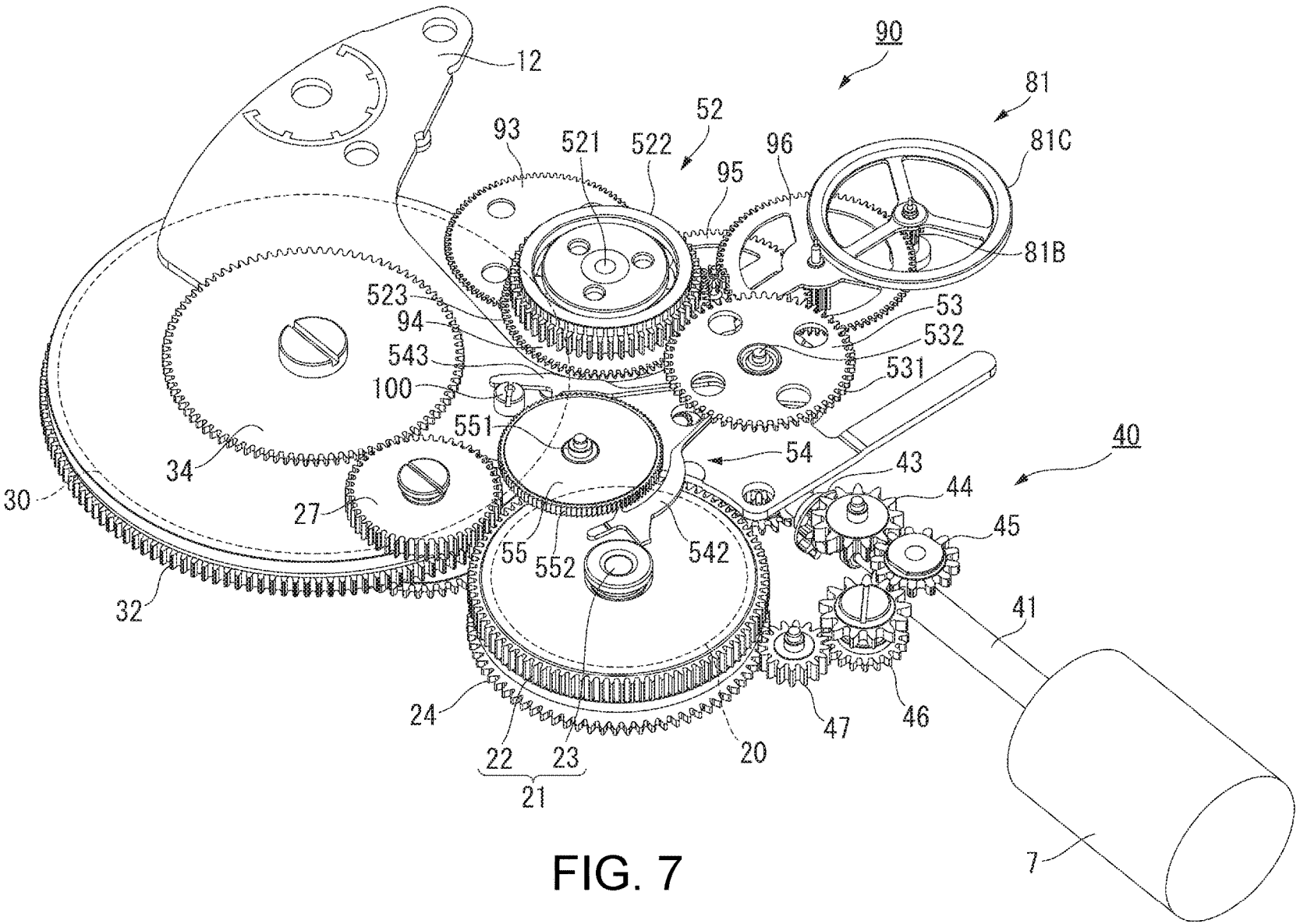
FIG. 7 is a plan view showing main parts of the movement in the first embodiment.
Figure 8:
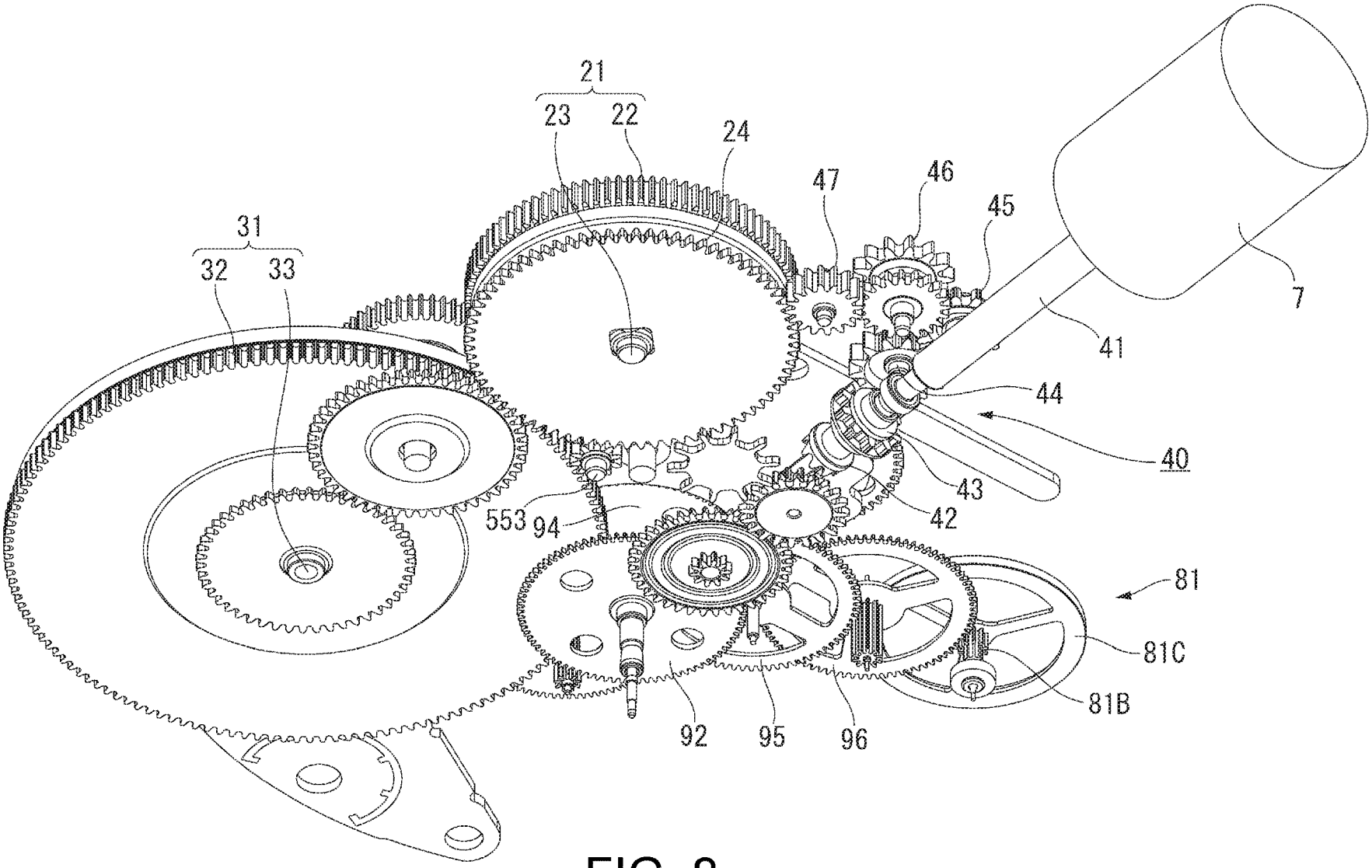
FIG. 8 is a plan view showing main parts of the movement in the first embodiment.

The movement 10 is described next with reference to FIG. 2 to FIG. 8. Note that FIG. 2 is a plan view showing main parts of the movement 10 from the back cover side, FIG. 3 is a plan view omitting the rotor 51 shown in FIG. 2, and FIG. 4 is a plan view omitting the train bridge 14 shown in FIG. 3. FIG. 5 is a section view of the area around the second barrel 31, and FIG. 6 is a section view of the area around the first barrel 21 and bearing 52. FIG. 7 and FIG. 8 are perspective views showing main parts of the movement 10.

Note that herein a plan view from the back cover side of the timepiece 1 refers to the view when seen from the direction parallel to the axial direction of the pivot 521 described below, and the view seen from a direction perpendicular to the axial direction of the pivot 521 is referred to as a side view. Note also that the top sides of the drawings in FIG. 5 and FIG. 6 are the back cover side, and the bottom side is the dial 3 side.

As shown in FIG. 4 and FIG. 5, the movement 10 includes a first barrel 21 in which the first spring 20 is held, and a second barrel 31 in which the second spring 30 is held. The hour hand 4A, minute hand 4B, second hand 4C, and power reserve indicator 5 are attached to pivots in the movement 10, and are driven by the first spring 20 and the second spring 30 of the movement 10.

As shown in FIG. 3 to FIG. 6, the movement 10 includes a main plate 11, a first bridge 12, a second bridge 13, and a train bridge 14. The first bridge 12 is disposed in a side view between the main plate 11 and the rotor 51 described below, and functions to hold the second barrel 31. Note that the first bridge 12 is an example of a holder or cover as described in the accompanying claims. The train bridge 14 functions to hold the wheel train complete.

The first barrel 21 in which the first spring 20 is held, the second barrel 31 in which the second spring 30 is held, and a manual winding mechanism 40 and an automatic winding mechanism 50 for winding the first spring 20 and the second spring 30, are disposed between the main plate 11 and the train bridge 14.

A power reserve display mechanism for indicating the reserve power of the first spring 20 and the second spring 30, a wheel train 90 that transfers torque from the first spring 20 and the second spring 30, and a generator 80 that is driven by torque transferred through the wheel train 90, are also disposed between the main plate 11 and train bridge 14.

As shown in FIG. 3, a first hole 141 is formed in the train bridge 14 at a position superimposed in plan view with an eccentric pin 100 described below. A second hole 142 is also formed in the train bridge 14 at a position where part of the second hole 142 is superimposed in plan view with the distal end 5424 of the pull pawl lever 542, and the remaining part of the second hole 142 is superimposed in plan view with a space between the distal end 5424 and the transmission wheel 55 described below.

In addition, a position indicator 141A indicating the position to which the eccentric pin 100 described below is set is disposed to the train bridge 14 around the first hole 141.

First Spring and First Barrel

As shown in FIG. 4 and FIG. 7, the first spring 20 is housed inside the first barrel 21. The first barrel 21 includes a first barrel wheel 22, and a first barrel arbor 23. As also shown in FIG. 6, a first ratchet wheel 24 that turns in unison with the first barrel arbor 23 is attached to the first barrel arbor 23. The first barrel arbor 23 is axially supported by the main plate 11 and train bridge 14.

Second Spring and Second Barrel

As shown in FIG. 4, FIG. 5, and FIG. 7, the second spring 30 is housed in the second barrel 31. The second barrel 31 includes a second barrel wheel 32, and a second barrel arbor 33. The second barrel arbor 33 can turn in unison with a second ratchet wheel 34. As shown in FIG. 5, the second barrel arbor 33 is axially supported by the main plate 11 and first bridge 12.

As shown in FIG. 7 and FIG. 8, the second spring 30 is wound by the first spring 20. More specifically, when the first spring 20 is wound and stores torque sufficient to wind the second spring 30, the first barrel wheel 22 of the first barrel 21 turns. The first barrel wheel 22 engages the second ratchet wheel 34 of the second barrel 31 through an intermediate barrel wheel 27, and when the first barrel wheel 22 turns, the second ratchet wheel 34 and the second barrel arbor 33 turn, and the second spring 30 is wound.

Therefore, the first spring 20 and the second spring 30 of the timepiece 1 according to this embodiment can be wound by both a manual winding mechanism 40 and an automatic winding mechanism 50 as described below.

Generator

As shown in FIG. 4 and FIG. 7, a generator 80 is configured by a rotor 81 and coil blocks 82 and 83.

The rotor 81 includes a rotor magnet 81A, a rotor pinion 81B, and a rotor inertial disk 81C. The rotor inertial disk 81C reduces variation in the speed of rotor 81 rotation due to variation in the drive torque from the second barrel wheel 32. The coil blocks 82 and 83 are each configured by a coil winding on a core.

When the rotor 81 turns due to an external torque, induced electromotive force is produced by the coil blocks 82 and 83, and the generator 80 outputs electrical energy to an IC chip, for example. A brake can be applied to the rotor 81 by shorting the coil, and by controlling the braking force, the rotational period of the rotor 81 can be controlled to a constant rate.

Wheel Train

The wheel train 90 that drives the hour hand 4A, minute hand 4B, and second hand 4C by mechanical energy from the first spring 20 and the second spring 30 is described next.

As shown in FIG. 4, FIG. 7, and FIG. 8, the wheel train 90 includes a center wheel 92, third wheel 93, fourth wheel 94, fifth wheel 95, and sixth wheel 96. Rotation of the second barrel wheel 32 is transferred to the center wheel 92 and sequentially accelerated through the third wheel 93, fourth wheel 94, fifth wheel 95, and sixth wheel 96, and transferred to the rotor 81.

The minute hand 4B is attached through a minute wheel not shown to the center wheel 92, and the second hand 4C is attached to the fourth wheel 94. The hour wheel is connected to the minute wheel through the minute wheel and pinion not shown, and the hour hand 4A is attached to the hour wheel.

The AC output of the generator 80 in this timepiece 1 is boosted, rectified, and charged to a smoothing capacitor by a rectifier circuit configured by a boost rectifier, full-wave rectifier, half-wave rectifier, or transistor rectifier, for example, and power from the capacitor drives a rotation control circuit not shown that controls the rotational period of the generator 80. The rotation control circuit is configured by an integrated circuit including, for example, an oscillator circuit, frequency divider, rotation detection circuit, rotation comparison circuit, and electromagnetic brake control means, for example, and a crystal oscillator is used for the oscillator circuit.

Manual Winding Mechanism

As shown in FIG. 7 and FIG. 8, the manual winding mechanism 40 includes a winding stem 41 to which the crown 7 is attached, sliding pinion 42, winding pinion 43, crown wheel 44, first intermediate ratchet wheel 45, second intermediate ratchet wheel 46, and third intermediate ratchet wheel 47. The third intermediate ratchet wheel 47 meshes with the first ratchet wheel 24.

The winding stem 41 and sliding pinion 42 therefore turn when the user winds the crown 7 at the 0 stop. When the crown 7 is at the 0 stop, the sliding pinion 42 engages the winding pinion 43, and rotation of the sliding pinion 42 is transferred sequentially from the winding pinion 43 to the crown wheel 44, first intermediate ratchet wheel 45, second intermediate ratchet wheel 46, and third intermediate ratchet wheel 47. As a result, the first ratchet wheel 24 and the first barrel arbor 23 turn, and the first spring 20 is wound.

In this embodiment the first intermediate ratchet wheel 45 is disposed pivotably, and is configured to disengage the second intermediate ratchet wheel 46 when the crown 7 is turned in the opposite direction as the winding direction. More specifically, the first intermediate ratchet wheel 45 is configured to move in the 12:00 direction shown in FIG. 4 when the crown 7 is turned in the opposite direction as the winding direction. As a result, the first spring 20 will not unwind if the user mistakenly turns the crown 7 in the opposite direction as the winding direction.

Note that the manual winding mechanism 40 is not limited to the configuration described above, and may be configured to unwind the first spring 20 in response to rotation of the crown 7.

Automatic Winding Mechanism

As shown in FIG. 2 and FIG. 4 to FIG. 8, the automatic winding mechanism 50 includes a rotor 51, a bearing 52, an eccentric wheel 53, a pawl lever 54, and a transmission wheel 55.

The rotor 51 has a weight 511 and an arm 512, and is disposed on the back cover side of the train bridge 14. In plan view, the rotor 51 forms a semi-circle centered on the pivot 521 of the bearing 52 described below.

The bearing 52 includes a pivot 521, an outer race 522, and a rotor pinion 523. The pivot 521 is disposed in plan view in the plane center of the dial 3, and is axially supported by the train bridge 14. The rotor 51 is attached to the outer race 522. As a result, the bearing 52 rotates in unison with the rotor 51.

As shown in FIG. 4 and FIG. 7, the eccentric wheel 53 includes an eccentric shaft member 532, and an eccentric wheel 531 attached to the eccentric shaft member 532. The eccentric shaft member 532 is axially supported by the main plate 11 and train bridge 14. The eccentric shaft member 532 also has an eccentric shaft disposed eccentrically to the pivot.

The eccentric wheel 531 meshes with the rotor pinion 523 of the bearing 52. As a result, the eccentric wheel 53 can turn in both forward and reverse directions in conjunction with the rotor 51.

Figure 9:
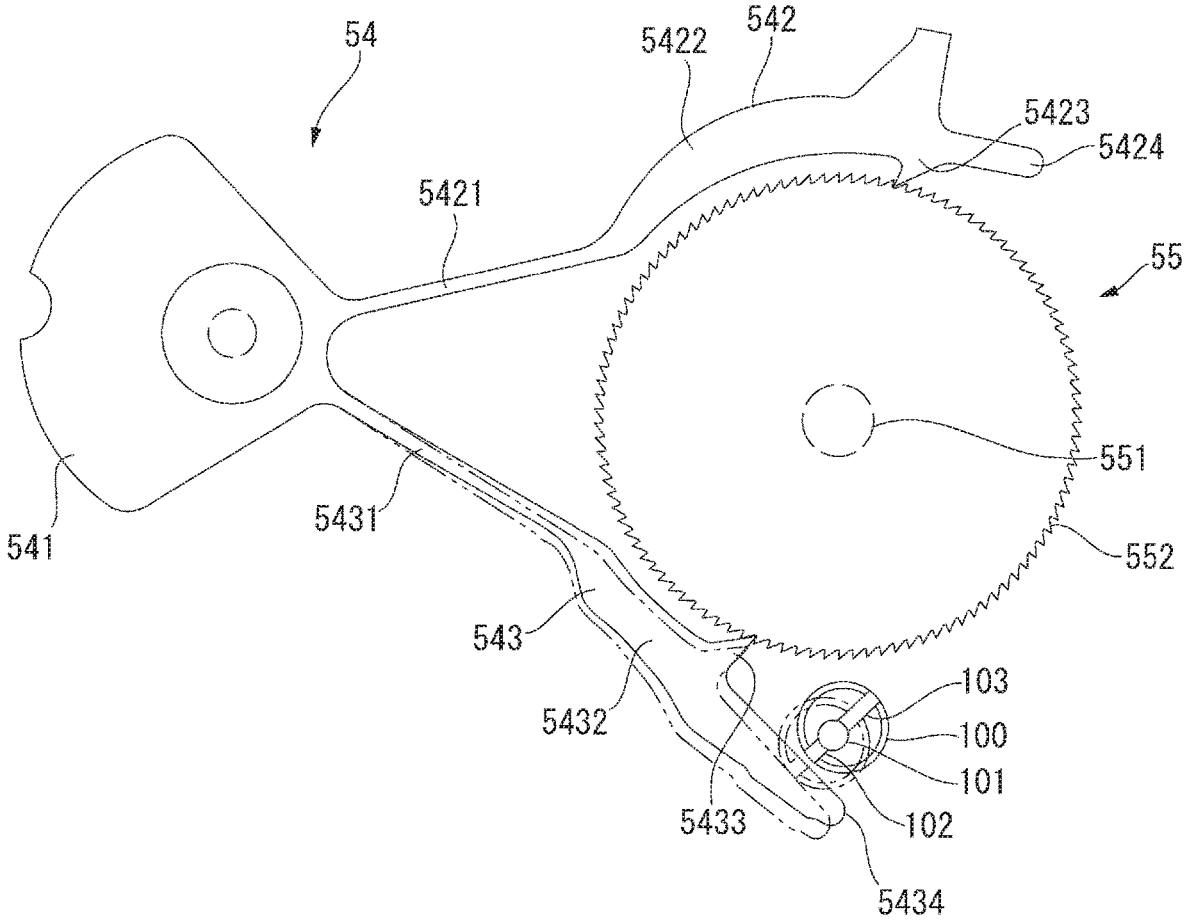
FIG. 9 is a plan view showing main parts of the pawl lever in the first embodiment.

FIG. 9 is a plan view showing main parts of the pawl lever 54.

As shown in FIG. 6, the pawl lever 54 is disposed in a side view between the rotor 51 and the first bridge 12. The pawl lever 54 is also attached to the eccentric shaft part of the eccentric shaft member 532 described above, and is axially supported through the eccentric shaft member 532 by the main plate 11 and train bridge 14. As a result, the pawl lever 54 moves back and forth in the directions toward and away from the transmission wheel 55 in conjunction with rotation of the eccentric shaft member 532.

As shown in FIG. 9, the pawl lever 54 has a base portion 541 with a hole in which the eccentric shaft member 532 of the eccentric wheel 53 is inserted. The pawl lever 54 also has a pull pawl lever 542 and a push pawl lever 543 that extend from the base portion 541 and in plan view are disposed with the first transmission wheel 552 of the transmission wheel 55 therebetween. Note that in plan view the distance between the pull pawl lever 542 and the push pawl lever 543 increases with distance from the base portion 541.

The pull pawl lever 542 includes an extender 5421, a curved portion 5422, a pull pawl 5423, and a distal end 5424. Note that the pull pawl lever 542 is an example of part of another pawl lever in this embodiment.

The extender 5421 extends straight from the base portion 541.

The curved portion 5422 continues from the extender 5421, and in plan view curves around the outside circumference of the first transmission wheel 552 described below.

The pull pawl 5423 protrudes from the curved portion 5422 toward the first transmission wheel 552, and can engage the first transmission wheel 552. The distal end 5424 extends from the distal end of the curved portion 5422.

The push pawl lever 543 includes a first extender 5431, a second extender 5432, a push pawl 5433, and a distal end 5434. Note that the push pawl lever 543 is an example of part of the other pawl lever in the accompanying claims.

The first extender 5431 extends straight from the base portion 541.

The second extender 5432 continues from the first extender 5431, and extends in the direction separating from the pull pawl lever 542 in plan view.

The push pawl 5433 protrudes from the second extender 5432 toward the first transmission wheel 552, and can engage the first transmission wheel 552.

The distal end 5434 extends from the distal end of the second extender 5432.

As shown in FIG. 4 and FIG. 6 to FIG. 9, the transmission wheel 55 includes a transmission wheel pivot 551, the first transmission wheel 552, and a second transmission wheel 553.

The transmission wheel pivot 551 is axially supported by the main plate 11 and train bridge 14.

The push pawl 5433 and the pull pawl 5423 of the pawl lever 54 engage the first transmission wheel 552, and the transmission wheel 55 turns in one direction in conjunction with the rocking action of the pawl lever 54.

The second transmission wheel 553 is engaged with the first ratchet wheel 24. As a result, the first ratchet wheel 24 turns in conjunction with rotation of the transmission wheel 55. When the first ratchet wheel 24 turns, the first barrel arbor 23 turns with the first ratchet wheel 24, and the first spring 20 is wound.

Eccentric Pin

Figure 10:
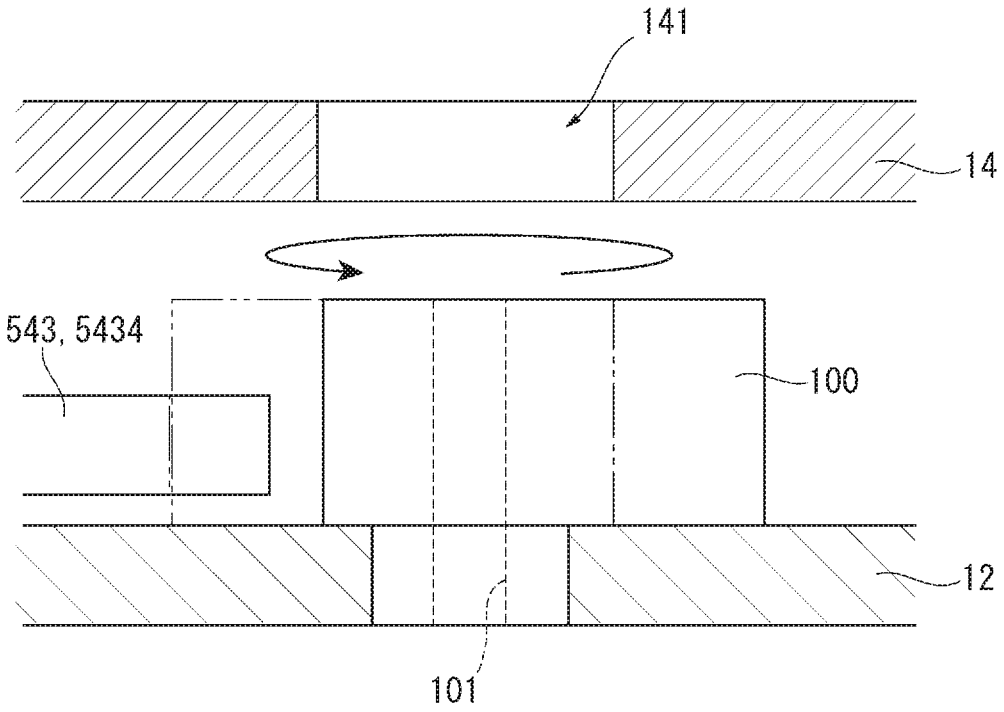
FIG. 10 is a section view showing main parts of the eccentric pin in the first embodiment.

FIG. 10 is a section view showing main parts of the eccentric pin 100.

As shown in FIG. 4, FIG. 7, FIG. 9, and FIG. 10, the eccentric pin 100 is disposed to the first bridge 12 between the push pawl lever 543 and the transmission wheel 55. A pivot hole 101 passing through the axial center is formed in the eccentric pin 100, and is disposed rotatably to the first bridge 12. A short channel 102 and a long channel 103 are formed in the head of the eccentric pin 100 with the pivot hole 101 therebetween. As a result, the eccentric pin 100 can be engaged with a tool such as a flat screwdriver.

As shown in FIG. 9 and FIG. 10, the eccentric pin 100 does not contact the distal end 5434 of the push pawl lever 543 when disposed as indicated by the solid lines in the figures. In this position, the push pawl 5433 of the push pawl lever 543 engages the first transmission wheel 552 of the transmission wheel 55. More specifically, the pawl lever 54 and the transmission wheel 55 are engaged in this position.

When the eccentric pin 100 is rotated from this position to the position indicated by the double-dot dash line, the eccentric pin 100 contacts the distal end 5434 of the push pawl lever 543. The push pawl lever 543 is therefore pushed by the eccentric pin 100, and deflects and moves away from the transmission wheel 55 as indicated by the double-dot dash line.

More specifically, the push pawl lever 543 moves in the direction away from the first transmission wheel 552. As a result, engagement of the push pawl 5433 of the push pawl lever 543 with the first transmission wheel 552 of the transmission wheel 55 is released. In other words, the transmission wheel 55 is released by the pawl lever 54, and the pawl lever 54 and transmission wheel 55 are disengaged.

In this way, the eccentric pin 100 is enabled to rotate and switch between an engaged position where the push pawl lever 543 and the transmission wheel 55 are engaged, and a released position where the push pawl lever 543 disengages and releases the transmission wheel 55.

Note that the eccentric pin 100 is an example of a release mechanism in the accompanying claims.

Unwinding the Springs

Unwinding the first spring 20 and the second spring 30 is described next with reference to FIG. 3, FIG. 9, and FIG. 10.

First, a flat screwdriver or other tool is inserted from the first hole 141 in the train bridge 14 shown in FIG. 3, and the tip of the tool is inserted to the short channel 102 and long channel 103 of the eccentric pin 100. The eccentric pin 100 is then turned so that the distal end of the long channel 103 moves to the position corresponding to the position indicator 141A. As a result, the eccentric pin 100 moves to the released position indicated by the double-dot dash lines in FIG. 9 and FIG. 10 as described above, and engagement of the push pawl 5433 of the push pawl lever 543 with the first transmission wheel 552 of the transmission wheel 55 is released.

Next, a flat screwdriver or other tool is inserted to the screw 46A in the second intermediate ratchet wheel 46 shown in FIG. 3, limiting rotation of the second intermediate ratchet wheel 46.

A pin, tweezers, or other tool with a round tip is then inserted from the second hole 142 in the train bridge 14 shown in FIG. 3. In this event, the tip of the pin contacts the distal end 5424 of the pull pawl lever 542. When the pin is then inserted further, the distal end 5424 slips along the end of the pin, and deflects relative to the pin to the opposite side as the push pawl lever 543 when seen in plan view. More specifically, the pull pawl lever 542 moves in the direction separating from the first transmission wheel 552. As a result, the pull pawl 5423 of the pull pawl lever 542 disengages the first transmission wheel 552 of the transmission wheel 55, and the first transmission wheel 552 is released.

The first spring 20 can then be unwound by turning the screw 46A of the second intermediate ratchet wheel 46 in the opposite direction as the winding direction while the transmission wheel 55 is disengaged from the pull pawl lever 542 and the push pawl lever 543. Because the first barrel wheel 22 is engaged with the second ratchet wheel 34 of the second barrel 31 through the intermediate barrel wheel 27 as described above, when the first spring 20 is unwound and torque is released, the second ratchet wheel 34 and second barrel arbor 33 turn, and the second spring 30 also unwinds. As a result, the first spring 20 and the second spring 30 are unwound to a specific position.

Note that in a configuration enabling unwinding the first spring 20 by turning the crown 7, the first spring 20 and the second spring 30 can be unwound by operating the crown 7 instead of operating the screw 46A of the second intermediate ratchet wheel 46.

Effect of the First Embodiment

Effects of the embodiment described above are described below.

The timepiece 1 according to this embodiment has, disposed to the first bridge 12, an eccentric pin 100 that enables changing between an engaged state in which the pawl lever 54 and transmission wheel 55 are engaged, and a released state in which the pawl lever 54 and transmission wheel 55 are not engaged.

The pawl lever 54 has a pull pawl lever 542 and a push pawl lever 543 disposed with the transmission wheel 55 therebetween in plan view, and the eccentric pin 100 is located between the push pawl lever 543 and the transmission wheel 55.

The eccentric pin 100 is configured to enable rotation to an engaged position where the push pawl lever 543 is engaged with the transmission wheel 55, and a released position where the push pawl lever 543 is not engaged with the transmission wheel 55. A second hole 142 is also disposed to the train bridge 14 at a position superimposed in plan view with the pull pawl lever 542 in plan view.

This configuration enables turning the eccentric pin 100 to disengage the push pawl lever 543 and the transmission wheel 55. The first spring 20 and the second spring 30 can be unwound by operating the screw 46A of the second intermediate ratchet wheel 46 by a flat screwdriver or similar tool while a pin is inserted to the second hole 142 and disengages the pull pawl lever 542.

In other words, when unwinding the first spring 20 and the second spring 30, the push pawl lever 543 can be disengaged by the eccentric pin 100. As a result, the operator can simply simultaneously perform two operations, the operation of inserting a pin to the second hole 142, and the operation of turning the screw 46A of the second intermediate ratchet wheel 46. Unwinding the springs is therefore simplified when compared with a process requiring simultaneously performing three operations, that is, an operation to disengage the engagement of one side of the pawl lever, an operation to disengage the engagement of the other side of the pawl lever, and an operation to unwind the springs.

Furthermore, because engagement of the pawl lever 54 and the transmission wheel 55 can be released without removing the train bridge 14, operation is easier than when the train bridge 14 must be removed, the automatic winding mechanism 50 disassembled, and the pawl lever 54 and transmission wheel 55 then disengaged.

In this embodiment the pawl lever 54 and transmission wheel 55 are axially supported by the main plate 11 and train bridge 14. More specifically, because the pawl lever 54 and transmission wheel 55 are axially supported by the same member, the positioning precision of the pawl lever 54 and transmission wheel 55 when engaged can be improved.

Furthermore, because the pawl lever 54 and transmission wheel 55 are axially supported by the train bridge 14, a separate member for axially supporting these does not to be provided. As a result, the thickness of the timepiece 1 in the axial direction of the pivot 521 can be reduced.

In this embodiment a position indicator 141A for indicating the position set by the eccentric pin 100 is disposed to the train bridge 14. In this embodiment, the released position is indicated when the distal end of the long channel 103 is at the position corresponding to the position indicator 141A, and the engaged position is indicated when the distal end of the short channel 102 is at the position corresponding to the position indicator 141A.

As a result, when the train bridge 14 is installed and the pawl lever 54 and transmission wheel 55 cannot be seen directly from the back cover side, the operator can easily determine if the eccentric pin 100 is in the release position.

In this embodiment the eccentric pin 100 contacts the distal end 5434 of the push pawl lever 543 when at the release position.

As a result, the push pawl lever 543 can be more easily deflected to disengage the transmission wheel 55 than in a configuration in which the eccentric pin 100 contacts the first extender 5431 of the push pawl lever 543. As a result, engagement of the pawl lever 54 with the transmission wheel 55 can be more reliably released.

In this embodiment the eccentric pin 100 is disposed to the first bridge 12.

As a result, the eccentric pin 100, pawl lever 54, and transmission wheel 55 can be installed when the train bridge 14 is not installed. The pawl lever 54 and transmission wheel 55 can be reliably changed between the engaged state and the released (disengaged) state by means of the eccentric pin 100.

Embodiment 2

A second embodiment of the present disclosure is described next with reference to FIG. 11.

The second embodiment differs from the first embodiment in that the eccentric pin 100A is disposed between the push pawl lever 543A and the pull pawl lever 542A.

Note that configurations that are the same as in the timepiece 1 according to the first embodiment are identified by like reference numerals and further description thereof is omitted.

Figure 11:
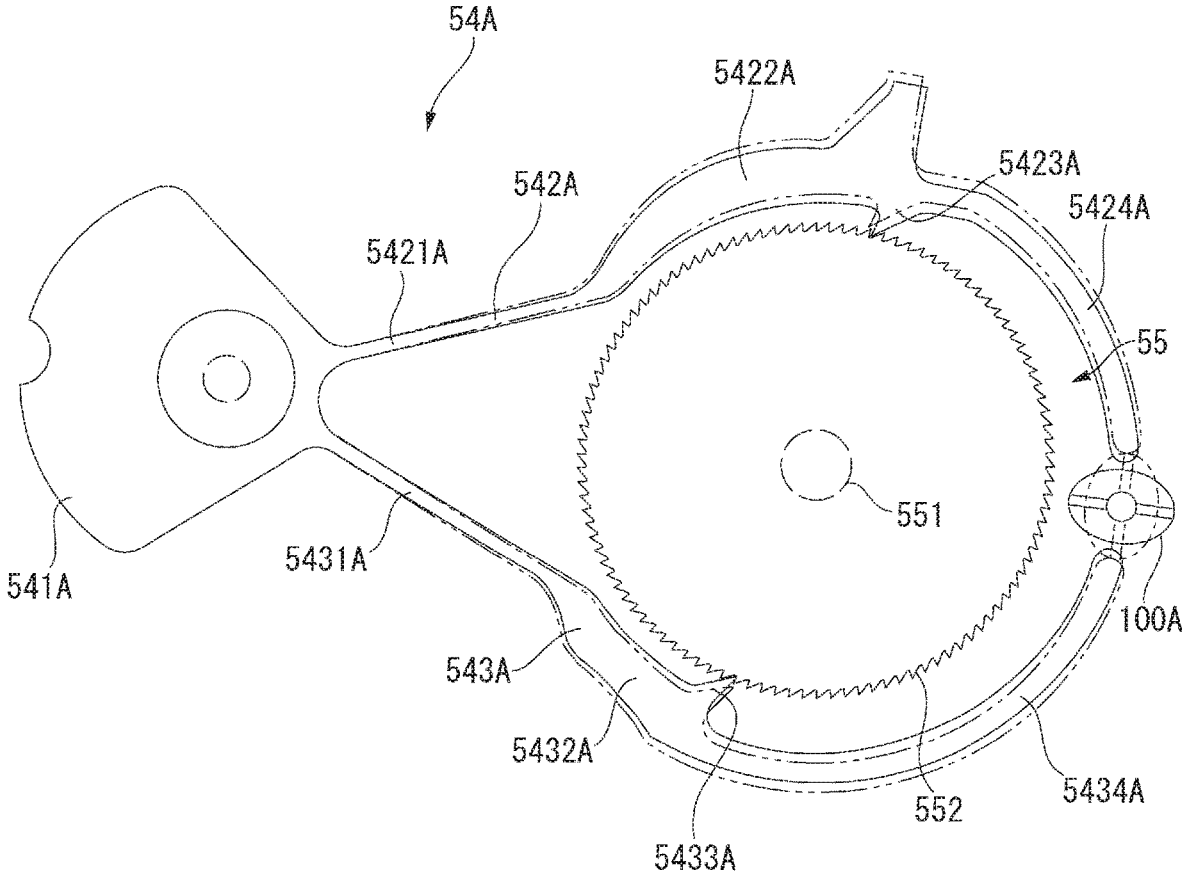
FIG. 11 is a plan view showing main parts of the pawl lever in a second embodiment.

FIG. 11 is a plan view showing main parts of the pawl lever 54A in the second embodiment.

As shown in FIG. 11, in this embodiment the pull pawl lever 542A includes an extender 5421A, a curved portion 5422A, a pull pawl 5423A, and a distal end 5424A.

The distal end 5424A curves along the outside circumference of the first transmission wheel 552, and extends to a position opposite the base portion 541A with the transmission wheel 55 therebetween.

The push pawl lever 543A includes a first extender 5431A, a second extender 5432A, a push pawl 5433A, and a distal end 5434A.

The distal end 5434A curves along the outside circumference of the first transmission wheel 552, and extends to a position opposite the base portion 541A with the transmission wheel 55 therebetween.

The eccentric pin 100A is disposed between the distal end 5424A of the pull pawl lever 542A, and the distal end 5434A of the push pawl lever 543A. More specifically, the eccentric pin 100A is located between the one pawl lever and the other pawl lever. The eccentric pin 100A has an oval head, and when in the engaged position indicated by the solid line in FIG. 11, the edges on the semi-minor axis (short axis) do not contact the pull pawl lever 542A and the push pawl lever 543A.

However, when in the release position indicated by the double-dot dash line, the edges on the semi-major axis (long axis) contact the distal end 5424A of the pull pawl lever 542A and the distal end 5434A of the push pawl lever 543A.

As in the first embodiment, a hole is formed in the train bridge 14 at a position superimposed in plan view with the eccentric pin 100A, and by means of a flat screwdriver or similar tool inserted from this hole, the eccentric pin 100A can be turned to the engaged position and the release position.

When the eccentric pin 100A is turned from the engaged position to the release position, the pull pawl lever 542A and the push pawl lever 543A are pushed by the eccentric pin 100A, and as indicated by the double-dot dash line, deflects and moves in the direction away from the transmission wheel 55. As a result, engagement of the pull pawl lever 542A and the push pawl lever 543A with the transmission wheel 55 is released.

More specifically, the eccentric pin 100A is configured to rotate between an engaged position where the pull pawl lever 542A and push pawl lever 543A are engaged with the transmission wheel 55, and a release position where the pawl levers are not engaged with the transmission wheel 55.

Effect of the Second Embodiment

Effects of the second embodiment described above are described below.

In this embodiment of the present disclosure the eccentric pin 100A is configured to enable rotation between an engaged position where the pull pawl lever 542A and push pawl lever 543A are engaged with the transmission wheel 55, and a release position where the pawl levers are not engaged with the transmission wheel 55.

As a result, engagement of the pull pawl lever 542A and push pawl lever 543A with the transmission wheel 55 can be released by turning the eccentric pin 100A while rotation of the second intermediate ratchet wheel 46 is limited. The first spring 20 and the second spring 30 can then be unwound by operating the screw 46A with a flat screwdriver or similar tool.

More specifically, because engagement of the pull pawl lever 542A and the push pawl lever 543A can be simultaneously released, the task of unwinding the springs is further simplified compared with when the pull pawl lever 542A and the push pawl lever 543A are disengaged by separate operations.

Embodiment 3

A third embodiment of the present disclosure is described next with reference to FIG. 12.

The third embodiment differs from the first and second embodiments described above in that the eccentric pin 100B is disposed to the train bridge 14.

Note that identical configurations in this and the timepiece 1 according to the first embodiment are identified by like reference numerals, and further description thereof is omitted.

Figure 12:
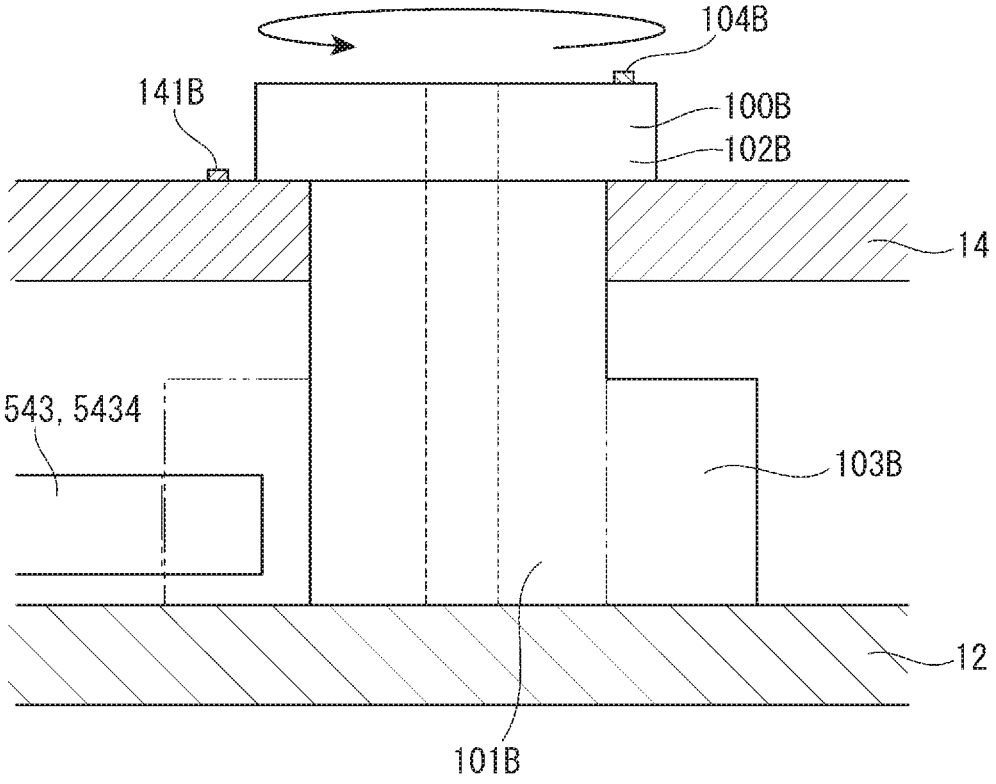
FIG. 12 is a section view showing main parts of the eccentric pin in a third embodiment.

FIG. 12 is a section view showing main parts of the eccentric pin 100B.

As shown in FIG. 12, the eccentric pin 100B in this embodiment is disposed to the train bridge 14.

The eccentric pin 100B includes a shank 101B, a head 102B, and an eccentric part 103B formed in unison. In plan view the eccentric part 103B is round, and the center of the eccentric part 103B is offset from the axial center of the shank 101B. More specifically, the eccentric part 103B is eccentric to the shank 101B.

The head 102B is disposed on the back cover side of the train bridge 14, and the eccentric part 103B is disposed between the train bridge 14 and the first bridge 12 at a position able to contact the distal end 5434 of the push pawl lever 543.

When in the engaged position indicated by the solid lines in FIG. 12, the eccentric part 103B of the eccentric pin 100B does not contact the distal end 5434 of the push pawl lever 543.

When in the release position indicated by the double-dot dash lines in FIG. 12, the eccentric part 103B of the eccentric pin 100B contacts the distal end 5434 of the push pawl lever 543. As a result, engagement of the push pawl lever 543 with the transmission wheel 55 is released.

More specifically, the eccentric pin 100B can be turned by operating the head 102B to a position where the push pawl lever 543 and the transmission wheel 55 are engaged, and a release position where the push pawl lever 543 and the transmission wheel 55 are not engaged.

Note that as in the first embodiment described above, a position indicator 141B indicating the engaged or released position of the eccentric pin 100B is disposed to the train bridge 14. A marker 104B is also disposed to the head 102B of the eccentric pin 100B. The operator can therefore easily move the eccentric pin 100B to the engaged position or the release position because the eccentric pin 100B moves to the release position when the eccentric pin 100B is turned so that the marker 104B moves to a position corresponding to the position indicator 141B.

Effect of the Third Embodiment

Effects of the third embodiment described above are described below.

In this embodiment an eccentric pin 100B configured to enable rotation between an engaged position where the push pawl lever 543 and the transmission wheel 55 are engaged, and a release position where the push pawl lever 543 is not engaged with the transmission wheel 55, is disposed to the train bridge 14.

As a result, the task of unwinding the first spring 20 and the second spring 30 can be simplified as in the first embodiment described above. In addition, because the eccentric pin 100B is disposed to the train bridge 14, the eccentric pin 100B can be disposed on the back cover side of the first bridge 12 where the first spring 20 is not located. More specifically, there is greater freedom in locating the eccentric pin 100B when compared with a configuration in which the eccentric pin 100B is disposed to the first bridge 12.

Other Embodiments

The invention is not limited to the embodiments described above, and can be modified and improved in many ways without departing from the scope of the accompanying claims.

In the first and third embodiments described above the eccentric pin 100, 100B is disposed to touch the push pawl lever 543 when at the release position, but the invention is not so limited. For example, the eccentric pin 100, 100B may be disposed to touch the pull pawl lever 542 when at the release position.

Alternatively, two eccentric pins may be provided, an eccentric pin that contacts the push pawl lever 543, and an eccentric pin that contacts the pull pawl lever 542.

For example, the eccentric pin 100 that contacts the push pawl lever 543, and the eccentric pin 100 that contacts the pull pawl lever 542, may be disposed on the first bridge 12. In other words, there may be two of the eccentric pins 100 described in the first embodiment. In this case, a holes are disposed in the train bridge 14 at positions superimposed in plan view with each eccentric pin 100.

Further alternatively, the eccentric pin 100B that contacts the push pawl lever 543, and the eccentric pin 100B that contacts the pull pawl lever 542, may be disposed to the train bridge 14, for example. In other words, there are two of the eccentric pins 100B described in the third embodiment.

Further alternatively, an eccentric pin 100 that contacts the push pawl lever 543 may be disposed to the first bridge 12, and another eccentric pin 100B that contacts the pull pawl lever 542 may be disposed to the train bridge 14. In other words, both the eccentric pin 100 described in the first embodiment, and the eccentric pin 100B described in the third embodiment, may be provided. In this case, an eccentric pin 100 that contacts the pull pawl lever 542 may be disposed to the first bridge 12, and an eccentric pin 100B that contacts the push pawl lever 543 may be disposed to the train bridge 14.

In the third embodiment the eccentric pin 100B is configured with a shank 101B, a head 102B, and an eccentric part 103B, but the invention is not so limited.

For example, the eccentric pin may be configured with the center of the head 102B offset from the axial center of the shank 101B, that is, configured with the head 102B eccentric to the shank 101B. This enables configuring the eccentric pin so that the push pawl lever 543 or the pull pawl lever 542 contacts the head 102B without requiring the eccentric part 103B.

More specifically, the distal end of the distal end 5434 of the push pawl lever 543 may be formed in a curve, for example, to protrude to the back cover side. A hole is also provided in the train bridge 14 at a position not engaging the distal end of the distal end 5434. By then configuring the distal end protruding from the hole and the head 102B so they do not touch at the engaged position and touch at the release position, the engagement state of the push pawl lever 543 and the transmission wheel 55 can be changed. A similar construction is used to make the pull pawl lever 542 and the head 102B touch.

When an eccentric pin 100 that contacts the push pawl lever 543 is disposed to the first bridge 12, and an eccentric pin 100 that contacts the pull pawl lever 542 is disposed to the train bridge 14, as described above, the eccentric pin disposed to the train bridge 14 may be configured so that the head 102B is eccentric to the shank 101B.

In the first and third embodiments, the eccentric pin 100, 100B is configured to contact the distal end 5434 of the push pawl lever 543 in the release position, but the invention is not so limited. For example, the eccentric pin 100, 100B may be configured so that it can contact the first extender 5431 of the push pawl lever 543. The eccentric pin 100, 100B may also be configured so that it can contact the extender 5421 of the pull pawl lever 542.

In the first and third embodiments, the second hole 142 is disposed to a position where part of the second hole 142 is superimposed in plan view with the distal end 5424 of the pull pawl lever 542, but the invention is not so limited. For example, the second hole 142 may be disposed to a position where part of the second hole 142 is superimposed in plan view with the extender 5421 of the pull pawl lever 542.

In addition, when the eccentric pin 100, 100B is configured to enable contact with the pull pawl lever 542, the second hole 142 may be disposed to a position where part of the second hole 142 is superimposed in plan view with the push pawl lever 543.

In the first and second embodiments described above, the pawl lever 54 and the transmission wheel 55 are axially supported by the main plate 11 and train bridge 14, but the invention is not so limited.

For example, the pawl lever 54 and transmission wheel 55 may be axially supported by the main plate 11 and the first bridge 12. In this case, the pivots of the pawl lever 54 and the transmission wheel 55 may be disposed to protrude to the train bridge 14 side of the first bridge 12 with the pawl lever 54 and transmission wheel 55 disposed to the distal ends of the pivots.

Because the eccentric pin 100, 100B that contacts the pawl lever 54 and the transmission wheel 55 are disposed on the same side of the first bridge 12 in this configuration, the positioning precision thereof can be improved. As a result, the pawl lever 54 and the transmission wheel 55 can be reliably moved to the engaged position and the release position by the eccentric pin 100, 100B.

In the embodiments described above, the timepiece 1 is configured with two springs, a first spring 20 and a second spring 30, but the invention is not so limited and the timepiece 1 may be a timepiece having only one spring. The timepiece 1 according to the foregoing embodiments is also not limited to an electronically controlled mechanical timepiece having a generator 80 and a wheel train 90, and may be a mechanical timepiece having an escape wheel and anchor or other type of regulator.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A timepiece comprising:

a main plate;

a barrel including a barrel arbor and a spring;

a ratchet wheel configured to rotate with the barrel arbor and wind the spring;

a rotor that rotates centered on a pivot;

a transmission wheel that causes the ratchet wheel to turn;

a bridge disposed between the rotor and the main plate when seen in a side view from a direction perpendicular to the pivot;

a pawl lever that is disposed in the side view between the rotor and the bridge, moves bidirectionally in a direction toward and a direction away from the transmission wheel in conjunction with the rotor, and causes the transmission wheel to turn in one direction;

a release mechanism that is disposed on the bridge, and can change between an engaged state, in which the pawl lever and the transmission wheel are engaged, and a released state, in which the pawl lever and the transmission wheel are not engaged; and a train bridge disposed in the side view between the pawl lever and the rotor, and having a first hole located at a position superimposed with the release mechanism when seen in a plan view from a direction parallel to the pivot.

2. The timepiece described in claim 1, wherein:

the pawl lever and the transmission wheel are axially supported by the main plate and the train bridge.

3. The timepiece described in claim 1, wherein:

the pawl lever includes two pawl lever parts disposed in plan view with the transmission wheel therebetween;

the release mechanism is an eccentric pin disposed between one of the pawl lever parts and the transmission wheel, and is rotatable between an engaged position where the one pawl lever part and the transmission wheel change to the engaged state, and a release position where the one pawl lever part and the transmission wheel change to the released state; and the train bridge has a second hole disposed in plan view to a position where part of the second hole is superimposed with the other pawl lever part, and the remaining part of the hole is superimposed with a space between the other pawl lever part and the pawl lever.

4. The timepiece described in claim 1, wherein:

the pawl lever includes two pawl lever parts disposed in plan view with the transmission wheel therebetween; and the release mechanism is an eccentric pin disposed between one pawl lever part and the other pawl lever part, and is rotatable between an engaged position where the one pawl lever part and the other pawl lever part change to the engaged state engaging the transmission wheel, and a release position where the one pawl lever part and the other pawl lever part change to the released state not engaged with the transmission wheel.

5. The timepiece described in claim 1, further comprising:

a position indicator that indicates the engaged state or the released state of the release mechanism.

6. A timepiece comprising:

a main plate;

a barrel including a barrel arbor and a spring;

a ratchet wheel configured to rotate in unison with the barrel arbor and wind the spring;

a rotor that rotates centered on a pivot;

a transmission wheel that causes the ratchet wheel to turn;

a pawl lever that is disposed in a side view from a direction perpendicular to the pivot between the rotor and the main plate, moves bidirectionally in a direction toward and a direction away from the transmission wheel in conjunction with the rotor, and causes the transmission wheel to turn in one direction;

a train bridge disposed in the side view between the pawl lever and the rotor; and a release mechanism that is disposed on the train bridge, and can change between an engaged state, in which the pawl lever and the transmission wheel are engaged, and a released state, in which the pawl lever and the transmission wheel are not engaged.

* * * * *